United States Patent [19]

Sanders

[11] Patent Number: 4,858,310

[45] Date of Patent: Aug. 22, 1989

[54] METHOD FOR SOLDERING A METAL FERRULE TO A FLEXIBLE COAXIAL ELECTRICAL CABLE

[75] Inventor: Mark S. Sanders, Newark, Del.

[73] Assignee: W. L. Gore & Associates, Inc., Newark, Del.

[21] Appl. No.: 180,505

[22] Filed: Apr. 12, 1988

[51] Int. Cl.[4] ..... H01B 13/00

[52] U.S. Cl. ..... 29/828; 29/860; 228/259; 228/36; 174/75 C; 439/874

[58] Field of Search ..... 29/828, 860; 228/132, 228/259, 36, 179; 174/75 C; 439/874, 875, 876

[56] References Cited

U.S. PATENT DOCUMENTS

| | | | |
|---|---|---|---|
| 3,525,143 | 3/1967 | DeVito | 228/259 |
| 3,828,419 | 8/1974 | Wanner | 228/259 |
| 4,679,723 | 7/1987 | Veit et al. | 29/828 |

FOREIGN PATENT DOCUMENTS

| | | | |
|---|---|---|---|
| 0056472 | 4/1985 | Japan | 228/259 |

*Primary Examiner*—P. W. Echols
*Assistant Examiner*—Kevin Jordan
*Attorney, Agent, or Firm*—Gary A. Samuels

[57] ABSTRACT

A method for terminating a coaxial electrical cable by dip-soldering a metal ferrule to the outer braided shield surrounding an end.

7 Claims, 2 Drawing Sheets

METHOD FOR SOLDERING A METAL FERRULE TO A FLEXIBLE COAXIAL ELECTRICAL CABLE

FIELD OF THE INVENTION

This invention pertains to methods for soldering metal electrical connector parts to a flexible coaxial electrical cable as a step in terminating the cable.

BACKGROUND OF THE INVENTION

In the present methods of attaching a flexible coaxial electrical cable to a connector to terminate the cable, the same basic steps are usually followed. The connector component to be attached is held in position relative to the cable by a holding fixture or mechanism and heat is applied to the components to bring the system up to soldering temperature by a method, such as resistance or induction heating. Solder is then added to fill the gap between the connector component and the cable. The solder can be added through a drilled hole in the connector component at some distance from the edge of the interface or at the edge of the interface.

There are some disadvantages to these methods, however, such as the difficulty of heating all component parts evenly to temperature and maintaining that temperature long enough to complete soldering. The usual manual soldering operation involves the operator watching the flow of solder between the components visually to maintain temperature regulation. Too much heat can burn a part or shrink dielectric insulation and too little heat can result in voids and a poor solder fillet at the interface. The time for hand soldering can be lengthy for good process control and joint quality. Such methods are illustrated in U.S. Pat. No. 3,665,367 to Keller, et al.

Similar methods are used with larger materials, such as pipe joints, as shown in U.S. Pat. No. 2,0947,495 issued to Robinson et al. Some of the above problems were overcome by dipping the parts to be soldered in a solder bath, as was used by Greever, as disclosed in U.S. Pat. No. 3,760,481 for joining pieces of metal tubing with zinc solder to form a heat exchanger.

BRIEF DESCRIPTION OF THE INVENTION

The invention pertains to a method for attaching a flexible coaxial electrical cable to a metal ferrule by dip-soldering them together as a step in terminating the coaxial cable. The process is applicable to dip-soldering an individual or single cable to a ferrule or a large number of cables to ferrules simultaneously in a multi-station-large volume production soldering machine.

DESCRIPTION OF THE PREFERRED EMBODIMENTS

Figure 1:
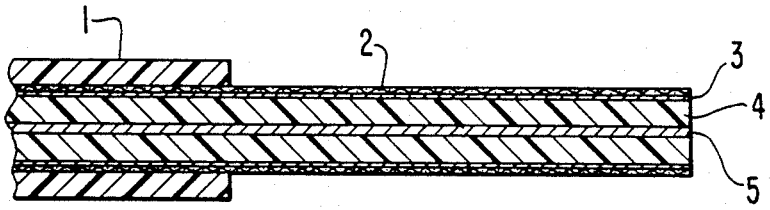
FIG. 1 shows cross-section of a coaxial cable as prepared for soldering with the outer protective jacket cut back and the shield braid exposed.

The invention is now described with reference to the drawings. FIG. 1 shows a typical coaxial electrical cable construction with an outer protective insulative jacket 1 peeled back from the reminder of the cable. Underlying jacket 1 is electrically conductive metal braided shield 2 which has been previously tinned to an underlying metal foil shield layer 3. These metal layers surround the principal dielectric material 4 of the cable which surrounds the electrically conductive signal-carrying center core 5. Center core 5 may be trimmed even with dielectric 4 and shields 3 and 2 or may optionally extend from the cable for convenience in further termination operations and may be masked against solder coating if desired.

Figure 2:
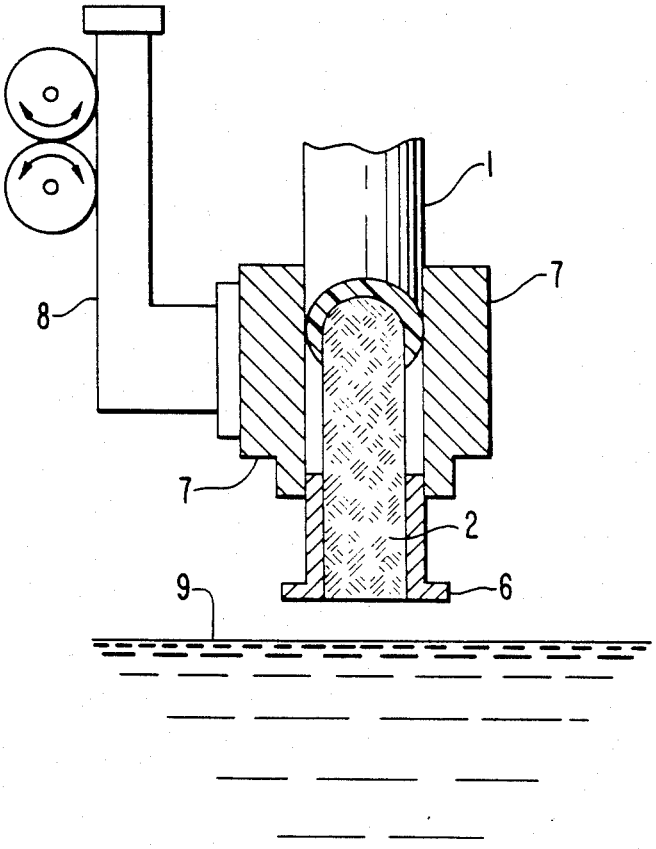
FIG. 2 describes a motorized solder dipping system with a ferrule in place on the end of a cable (in cross section) for dipping into a bath of molten temperature-controlled solder.

FIG. 2 displays symbolically a motorized dipping system 8 for raising and lowering an object, in this case a prepared end of coaxial electrical cable 1 and a metal ferrule 6, held in position in clamp 7, into a temperature controlled bath of molten solder 9.

Figure 3:
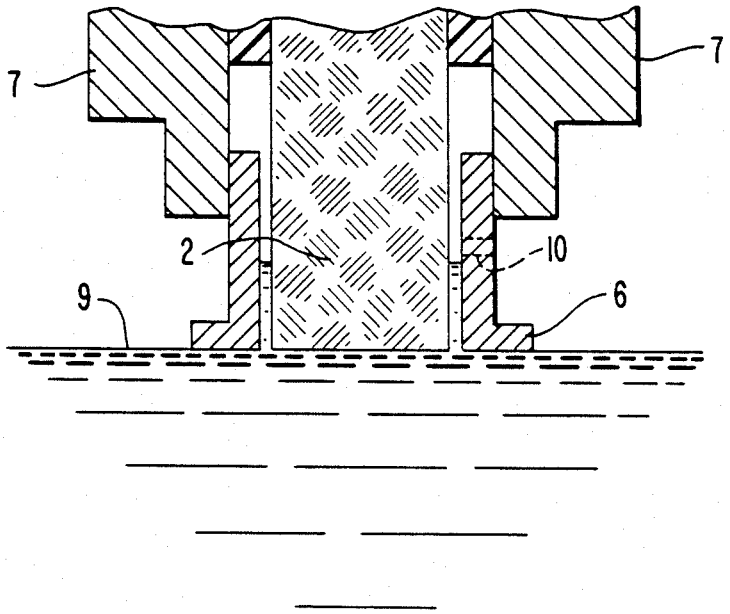
FIG. 3 depicts a cross-section of the cable and ferrule in contact with the solder bath and solder flowing into the gap between the walls of the ferrule and the cable.

With solder bath 9 in place and cable 1 and ferrule 6 held in clamp 7 at an appropriate spacing, system 8 lowers the cable end and surrounding ferrule to the surface of the solder and holds it in contact for a specified length of time as shown in FIG. 3. Molten solder wicks up into the gap between the surface of braid 2 and ferrule 6. Any flux gases or trapped air may exit vent 10 if present. The solder fill is 360° complete around the circumference and as much of the length of the gap may be filled as desired. The connection is now withdrawn, cooled, and removed from clamp 7. A multiplicity of clamps could be set up to receive and hold cables and ferrules which could all be soldered simultaneously in a similar temperature-controlled bath designed to receive them.

Complete and even heating of the substrate to be filled with solder and the even dipping in a large source of molten solder result in highly reliable complete and even filling of the soldered joint. This is difficult to do and of uneven reliability by manual heating systems and side or edge introducing of solder from a rod, coil, stick, or other hand held form usually available. Manual operation usually means visual feedback from the solder flow into the gap between cable and connector followed by manual regulation of heating and solder input. Too much heat can shrink the dielectric or burn a part and too little heating may result in a termination having voids and/or a poor fillet at the interface. Manual temperature control may be a lengthy operation to achieve a quality joint consistently and the soldering step is often the most expensive step in the termination process.

The ferrule 6 has preferably low mass for good heat transfer and since the connection is usually mechanical, the face of the ferrule is masked to prevent adherence of solder to it during the solder dipping process. This prevents cold flow when the ferrule is mated.

It will be apparent to those skilled in the art that various modifications and variations could be made in the process of the invention without departing from the scope or spirit of the invention and the scope of the invention is delineated only by the appended claims.

I claim:

1. A method for soldering an electrically and thermally conductive metal ferrule to a coaxial electrical cable having a protective polymeric jacket, an electrically conductive metal braided shield, a metal foil shield, a layer of dielectric material and an electrically conductive signal-carrying center core, said method comprising the steps of:

(a) stripping and trimming said polymeric jacket, said braided shield, said foil shield, said dielectric material, and said center core to a specified length;

(b) positioning said ferrule on the end of said cable;

(c) masking surfaces of said ferrule intended to be solder-free;

(d) placing in contact said ferrule and said cable end with a bath of solder such that a desired amount of solder is deposited between said ferrule and said cable;

(e) removing said ferrule and said cable from said bath; and (f) cooling said ferrule and said cable.

2. The method of claim 1 wherein said conductive metal shielding on said coaxial cable is pre-tinned prior to said soldering process.

3. The method of claim 1, wherein said ferrule and said cable are clamped to an apparatus for raising and lowering them as a unit into a bath of molten solder.

4. The method of claim 1, wherein said solder bath is temperature controlled and said solder therein has a higher heat content than that of said ferrule and said cable.

5. The method of claim 2, wherein said coaxial cable includes a braided metallic shield.

6. The method of claim 2 wherein said coaxial cable includes both a braided metallic shield and a wrapped metal foil shield which shields are tinned together.

7. The method of claim 1 or 4, wherein a multiplicity of cables and ferrules are mounted together in a holding fixture and soldered simultaneously.

* * * * *